US005207298A

United States Patent [19]

Donohoe et al.

[11] Patent Number: 5,207,298

[45] Date of Patent: May 4, 1993

[54] ELEVATOR ROTARY DOOR INTERLOCK

[75] Inventors: Michael P. Donohoe, Simsbury; Richard E. Kulak, Bristol, both of Conn.; Christian G. Tonna, Sao Paulo, Brazil

[73] Assignee: Otis Elevator Company, Farmington, Conn.

[21] Appl. No.: 840,424

[22] Filed: Feb. 24, 1992

[51] Int. Cl.[5] ..... B66B 1/00

[52] U.S. Cl. ..... 187/31; 187/62; 187/65

[58] Field of Search ..... 187/30, 31, 62, 65, 187/133, 57

[56] References Cited

U.S. PATENT DOCUMENTS

| | | | |
|---|---|---|---|
| 978,269 | 12/1910 | Collier | 187/31 X |
| 1,453,551 | 5/1923 | Fogal | 187/31 |
| 2,060,283 | 11/1936 | Cullmer | 187/31 |
| 2,378,218 | 6/1945 | Hard | 187/31 |
| 3,292,737 | 12/1966 | Crispen et al. | 187/31 |
| 4,483,420 | 11/1984 | Byrne | 187/31 |

*Primary Examiner*—Robert P. Olszewski
*Assistant Examiner*—Dean A. Reichard

[57] ABSTRACT

An elevator door interlock has a camming surface which is in contact with a lead of an electrical circuit and has a bridge thereon. The camming surface rotates the bridge into contact with the lead if a hoistway door is locked and out of contact with the lead if the hoistway door is not locked.

6 Claims, 2 Drawing Sheets

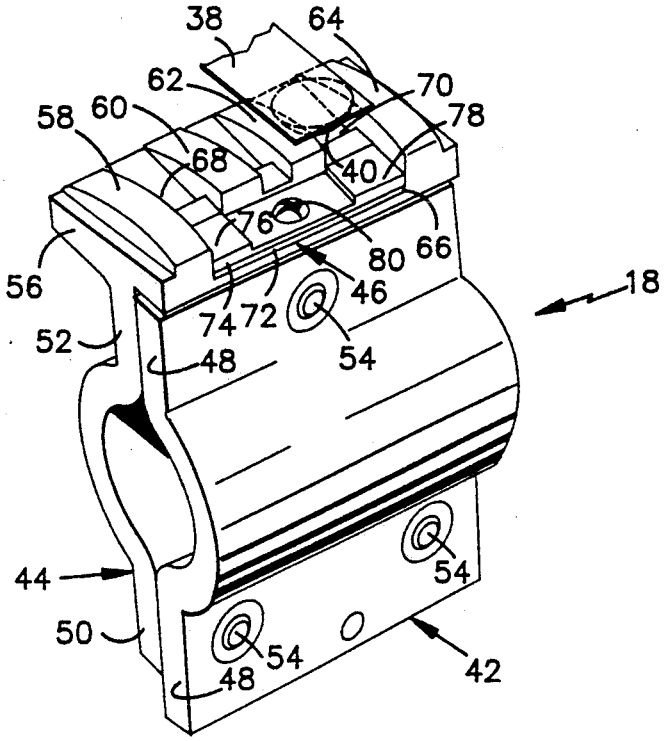
fig.2
fig.3
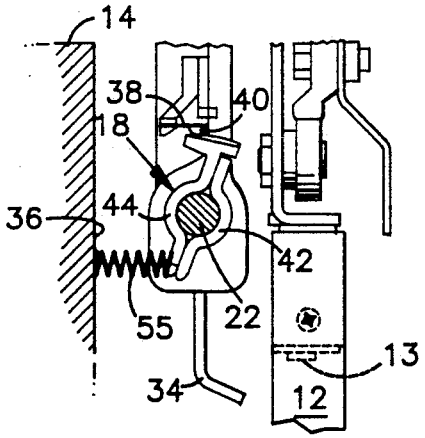
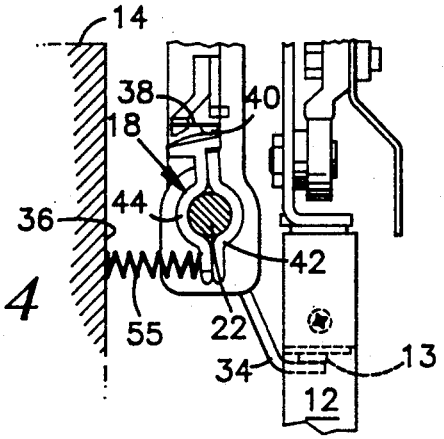
fig.4

ELEVATOR ROTARY DOOR INTERLOCK

TECHNICAL FIELD

This invention relates to an elevator door electrical interlock.

BACKGROUND OF THE INVENTION

Passenger elevators generally have a car having a pair of doors and a landing having a pair of hoistway doors. Both the car and hoistway doors open and close approximately in register with each other to allow passengers to enter and exit the elevator car. When the car is not at the landing, the hoistway doors must be locked to protect passengers standing at the landing from entering the elevator hoistway.

It is a safety requirement to equip the hoistway doors with a lock and an electrical contact (or "interlock") to ensure that the doors are positively locked. A typical lock consists of a latch attached to a hoistway door and a catch attached to a hoistway header. A typical open electrical circuit interlock consists of a pair of blade springs attached to the catch, and a bridge attached to the latch. If the hoistway doors are properly closed, the latch engages the catch and bridges the open electrical circuit. The completed electrical circuit sends a signal to a controller which indicates that the doors are properly locked and it is therefor safe to move the elevator car.

However, when bridge engages the electrical circuit, excessive noise may result. Further, the bridge may bounce away from the electrical circuit, which may lead to maintenance and operation problems.

DISCLOSURE OF THE INVENTION

It is an object of the invention to provide a reliable, relatively trouble-free interlock.

It is a further object of the invention to provide an interlock which operates in a relatively noise free manner.

According to the invention, an elevator door interlock has a camming surface which is in contact with a lead of an electrical circuit and has a bridge thereon. The camming surface rotates the bridge into contact with the lead if an elevator door is locked and out of contact with the lead if the elevator door is not locked. Because the camming surface is always in contact with the leads, there is relatively little contact noise and a minimal probability that the interlock bridge bounces away from the leads.

According to a feature of the invention, the lead slides in a groove within the camming surface when the door is open. The groove prevents the material of the camming surface from contaminating the surface of the lead which engages the bridge thereby improving the electrical contact between the lead and the bridge and the life of the interlock.

These and other objects, features, and advantages of the present invention will become more apparent in light of the following detailed description of a best mode embodiment thereof, as illustrated in the accompanying drawing.

BRIEF DESCRIPTION OF THE DRAWING

FIG. 2 is a perspective view of the interlock of FIG. 1;

FIG. 3 is a side view of the interlock of FIG. 1 if the hoistway door is open; and, FIG. 4 is a side view of the interlock of FIG. 1 if the hoistway door is closed.

BEST MODE FOR CARRYING OUT THE INVENTION

Figure 1:
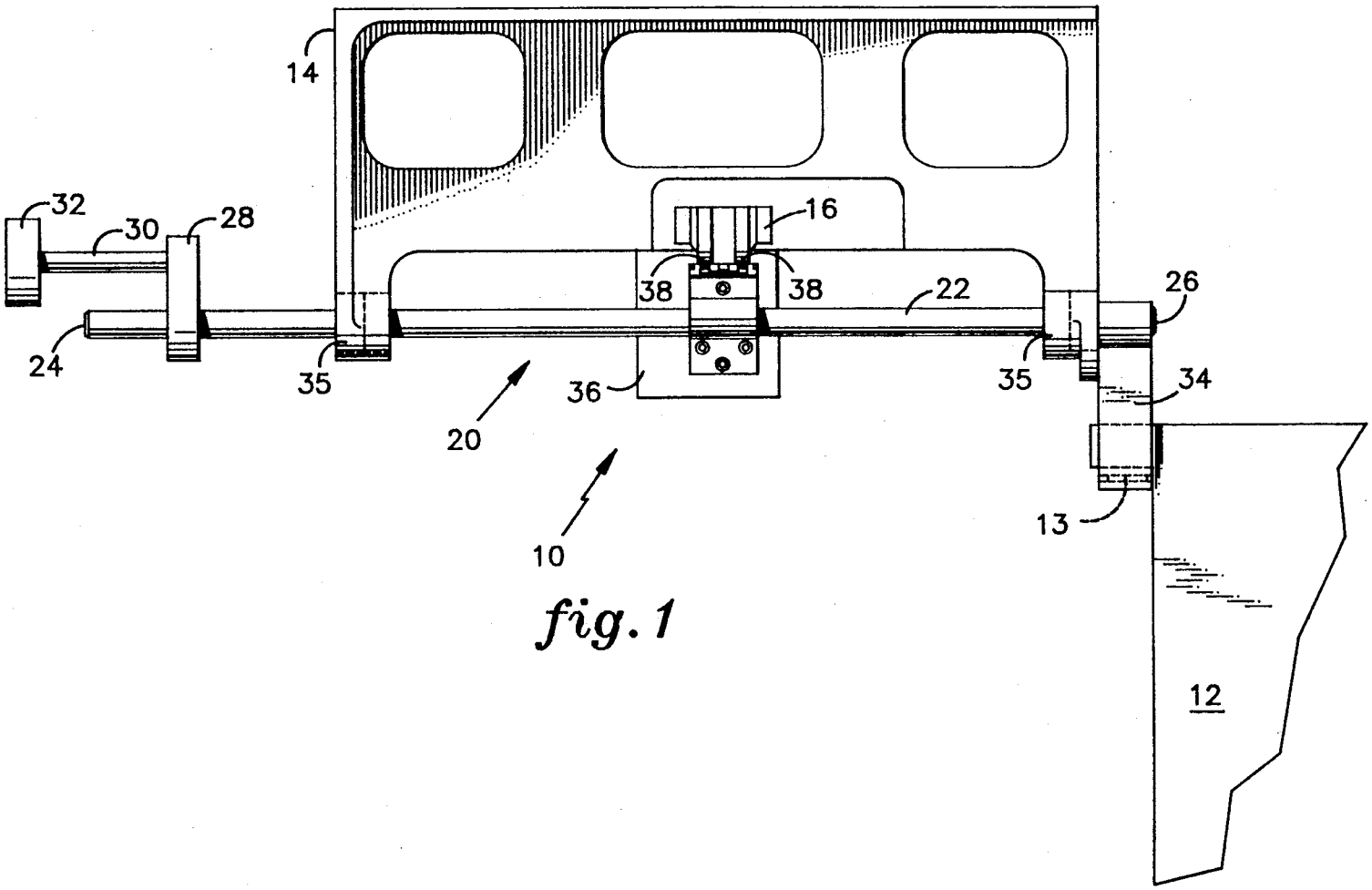
FIG. 1 is a front view of a hoistway door lock employing an interlock of the invention.

Referring to FIG. 1, an elevator hoistway door lock 10 employing an embodiment of the interlock of the invention is shown. The hoistway door lock shown is typically utilized with an elevator car (not shown) which has a retiring cam (not shown) which moves the hoistway door lock out of contact with a hoistway door 12 as is known in the art. The door has a bumper bracket 13 mounted thereto as will be discussed infra.

The hoistway door lock 10 comprises a brace 14 attached to a hoistway (not shown), a bracket 16, an interlock 18, and a locking linkage 20.

The locking linkage 20 comprises a rotatable shaft 22 having a first end portion 24 and a second end portion 26. An arm 28, an axle 30, and a cam following roller 32 are fixedly attached to the first end portion. A locking tab 34 is fixedly attached to the second end portion. The locking tab 34, the arm 28, the axle 30, and the roller 32 all rotate with the shaft 22.

The brace 14 has a pair of journal bearings 35 which rotatably support the shaft 22. The bracket 16 is attached to the brace between the journal bearings 35. The brace has a downwardly extending flange 36 (see also FIGS. 3–5) which acts as a spring seat as will be discussed infra.

The bracket 16 holds a pair of electrical leads 38 (see also FIGS. 3–5). The leads are part of an electrical circuit (not shown) which, when closed, signals a controller (not shown) that the doors are properly locked as is known in the art. Each lead 38 has a button contact 40 riveted thereto as is known in the art.

Referring to FIG. 2, the interlock 18 is shown. The interlock comprises a first plastic half 42, a second plastic half 44 and a bridge 46. The first plastic half has a u-shaped cross-section and a pair of legs 48 extending therefrom. Similarly, the second plastic half has a u-shaped cross-section and a first leg 50 and a second leg 52 extending therefrom. The u-shaped cross-sections of the first and second halves enclose the shaft 22 when they are attached together by screws 54 or the like. A spring 55 impinges against the first leg 50 and the flange 36 and reacts to motion of the retiring cam (not shown).

The second leg 52 of the second half 44 has a platform 56 having a first camming surface 58, a second camming surface 60, a third camming surface 62, a fourth camming surface 64, and a rectangular indentation 66 for receiving the bridge 46. A first channel 68 is formed between the first and second camming surfaces and a second channel 70 is formed between the third and fourth camming surfaces. The channels have sufficient width and depth to allow edges of the contact buttons 40 to travel along the edges of the respective camming surfaces 58–64. By allowing the buttons to travel along their edges, the portion of the buttons that contact the bridge do not contact the plastic material of the interlock thereby avoiding the transfer of any of that material to the button. Contact between each button contact 40 and the bridge 46 is therefor metal to metal insuring long life and reliability.

The bridge 46 has a first layer 72 of a conductive material, such as copper, and a second layer 74 of a highly conductive material such as silver. The second layer 74 has a first raised contact portion 76 and a second raised contact portion 78 for engaging the buttons 40. The first raised portion aligns with channel 68 and the second raised contact portion aligns channel 70. The bridge is attached to the platform 56 within the rectangular indentation 66 by a screw 80 or the like.

Referring to FIGS. 3 and 4, the operation of the switch is shown. If the locking linkage 20 is rotated by the retiring cam (not shown), the locking tab rotates in the clockwise direction out of the way (see FIG. 3) of the door 12 to allow it to open. The interlock 18 is rotated in the clockwise direction out of contact with the leads thereby breaking the circuit to signal the controller that the hoistway doors are open thereby preventing the car from moving. The spring 55 is compressed by the rotation of the interlock.

If it is time to move the car (referring to FIG. 4), the retiring cam is withdrawn and the locking linkage 20, due to the force of spring 55 and gravity force acting on the roller 32, rotates in the counterclockwise direction to move the locking tab 34 into contact with the hoistway door bumper bracket 13, thereby locking the hoistway door 12 closed. The interlock is also rotated in the counterclockwise direction with the shaft thereby moving the contact buttons along the edges of the channels until they contact the raised portions 76, 78 of the bridge 46 thereby closing the circuit to signal the controller that the hoistway doors are closed and that therefor the car may move safely. The channels may be shaped to allow the leads to drop, as opposed to sliding, onto the raised portions 76, 78 of the bridge to avoid scraping contact that might wear the raised portions away thereby limiting the life of the bridge 46.

Although, the invention has been shown and described with respect to a best mode embodiment thereof, it should be understood by those of ordinary skill in the art, that various omission, changes and additions in the form and detail thereof may be made without departing from the spirit and scope of the invention.

We claim:

1. An elevator door interlock which bridges a lead of an electrical circuit to indicate that the elevator door is locked, said interlock comprising:

a rotatable camming surface contacting said lead, and a bridge disposed upon said surface, said camming surface rotating the bridge into contact with the lead if said door is locked and out of contact with the lead if the door is not locked.

2. The interlock of claim 1 further comprising;

grooves disposed in said camming surface, said groove defining edges over which first portions of said lead slide such that second portions of said lead that contact said bridge do not contact said camming surface, thereby improving the electrical contact between said lead and said bridge and the life of the interlock.

3. The interlock of claim 2 wherein said bridge is recessed within said camming surface below said camming surface to minimize wear upon said bridge.

4. An elevator door interlock which bridges a lead of an electrical circuit to indicate that the elevator door is locked, said interlock comprising:

a rotatable camming surface contracting said lead, a bridge disposed upon said surface, said means for rotating said camming surface to rotate said bridge into contact with said lead if said door is locked and out of contact with said lead if said door is not locked.

5. The interlock of claim 4, further comprising;

grooves disposed in said camming surface, said groove defining edges over which first portions of said lead slide such that second portions of said lead that contact said bridge do not contact said camming surface, thereby improving the electrical contact between said lead and said bridge and the life of the interlock.

6. The interlock of claim 5 wherein said bridge is recessed within said camming surface below said camming surface to minimize wear upon said bridge.

* * * * *